US007988458B2

(12) United States Patent
Lin

(10) Patent No.: US 7,988,458 B2
(45) Date of Patent: Aug. 2, 2011

(54) SOCKET CONNECTOR FOR DIGITAL CAMERA MODULE

(75) Inventor: Pao-Chun Lin, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/716,344

(22) Filed: Mar. 3, 2010

(65) Prior Publication Data

US 2011/0117756 A1 May 19, 2011

(30) Foreign Application Priority Data

Nov. 17, 2009 (CN) ..... 2009 2 0314917 U

(51) Int. Cl.
*H01R 12/00* (2006.01)

(52) U.S. Cl. ..... 439/67

(58) Field of Classification Search ..... 439/71, 439/330, 67, 77; 361/816, 818
See application file for complete search history.

(56) References Cited

U.S. PATENT DOCUMENTS 7,147,481 B2 * 12/2006 Yang ..... 439/71
7,214,083 B2 * 5/2007 Chen et al. ..... 439/330
7,288,003 B2 * 10/2007 Ono et al. ..... 439/607.01
7,682,159 B2 * 3/2010 Huang et al. ..... 439/71

* cited by examiner

*Primary Examiner* — Khiem Nguyen
(74) *Attorney, Agent, or Firm* — Steven M. Reiss

(57) ABSTRACT

A socket connector for a digital camera module includes a base, a plurality of contact terminals, and a flex printed circuit board. The base includes a base body and a plurality of arms extending from the base. The contact terminals are mounted in the base, each contact terminal including an angled portion and a bent portion, the angled portion electronically connected to the digital cameral module. The flex printed circuit board is electronically connected to the bent portion.

9 Claims, 4 Drawing Sheets

SOCKET CONNECTOR FOR DIGITAL CAMERA MODULE

BACKGROUND

1. Technical Field

The present disclosure generally relates to socket connectors and, particularly, to a socket connector for use in a digital cameral module of a portable electronic device.

2. Description of Related Art

Generally, digital cameras modules need to be mounted to printed circuit boards of portable electronic devices. To secure a stable connection, a digital camera module needs to electronically connect to a printed circuit board with a socket connector. However, the digital camera module and the socket connector are often integral, with the digital camera module inseparable from the socket connector. If the digital camera or the socket connector become damaged or destroyed, the digital cameral module and the socket connector have to be replaced together. Thus, the costs are relatively high.

Therefore, there is room for improvement within the art.

BRIEF DESCRIPTION OF THE DRAWINGS

Many aspects of the socket connector can be better understood with reference to the following drawings. The components in the drawings are not necessarily drawn to scale, the emphasis instead being placed upon clearly illustrating the principles of the socket connector. Moreover, in the drawings, like reference numerals designate corresponding parts throughout the several views, in which.

DETAILED DESCRIPTION

Figure 1:
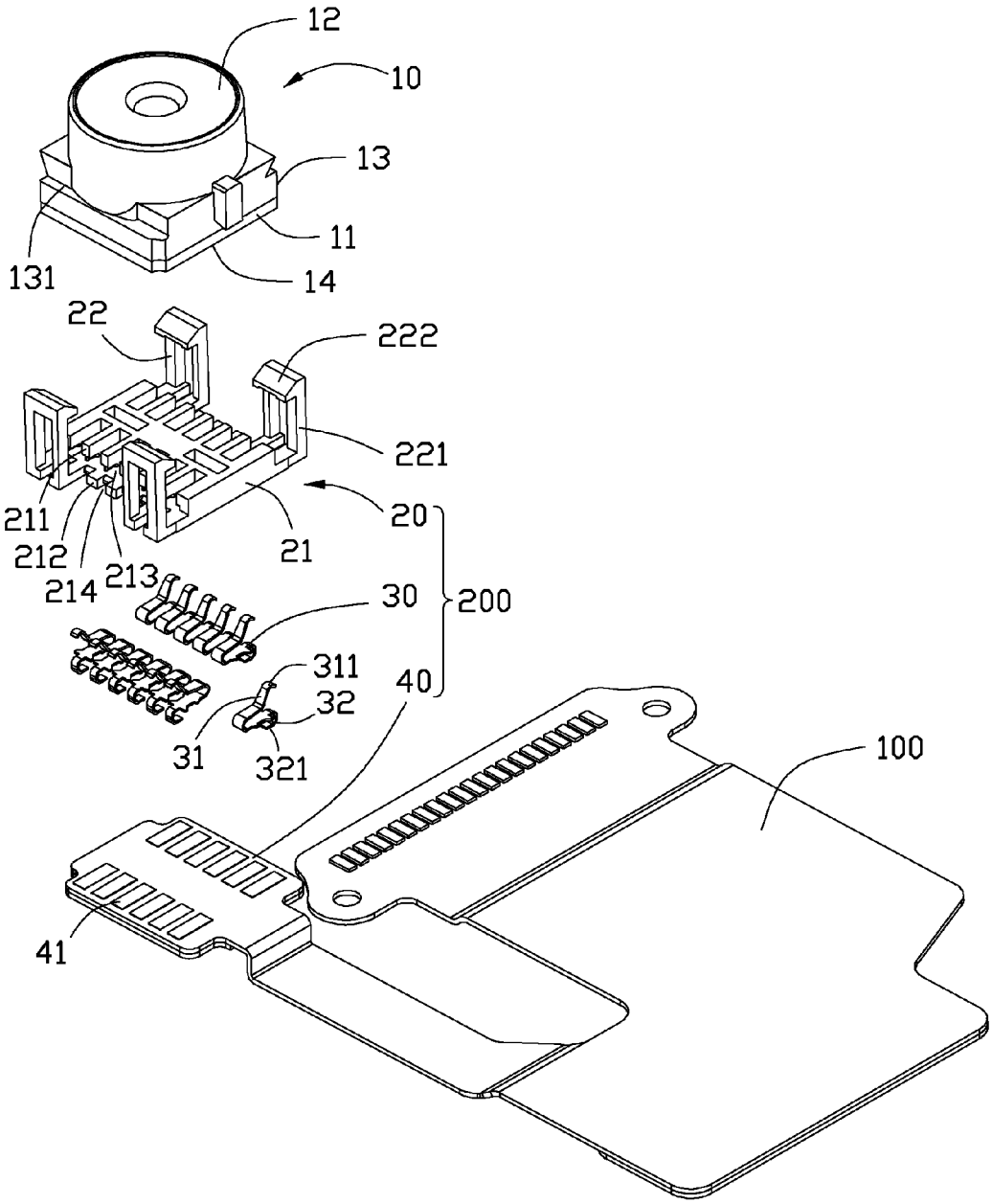
FIG. 1 is an exploded, isometric view of a socket connector connected to a printed circuited board in accordance with an exemplary embodiment.
Figure 2:
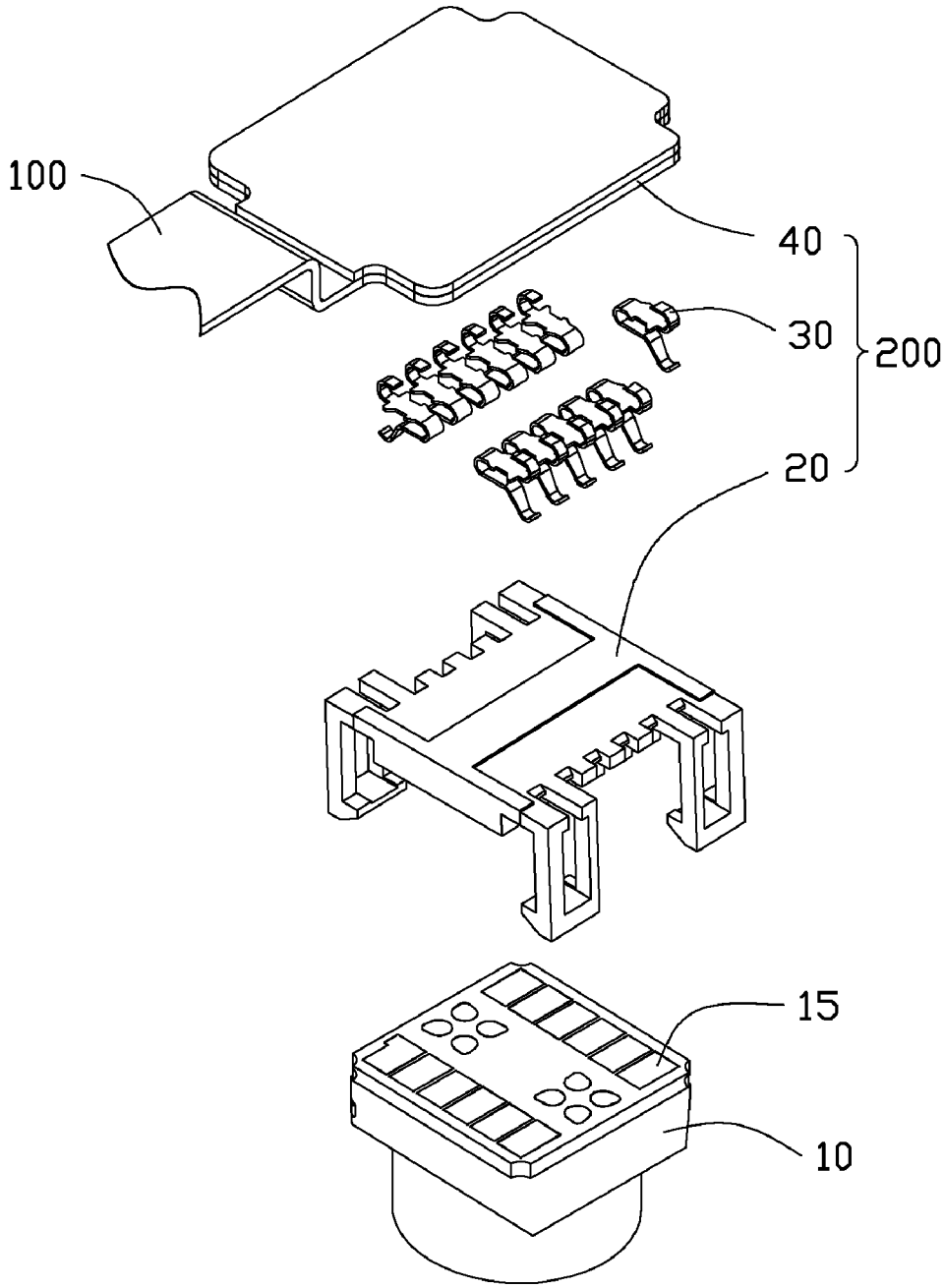
FIG. 2 is similar to FIG. 1, but shown from another aspect.

FIGS. 1 and 2 show a socket connector 200 connecting a digital cameral module 10 to a printed circuit board 100. The digital camera module 10 and the printed circuit board 100 are exemplary applications, for the purposes of describing details of an exemplary embodiment of the socket connector 200, although the disclosure is not limited thereto. In the exemplary embodiment, the digital cameral module 10 includes a seat 11 and a lens module 12. The seat 11 includes two side surfaces 13 and a bottom surface 14. Each side surface 13 forms a stepped portion 131. The bottom surface 14 seats a plurality of first contacts 15. The socket connector 200 includes a base 20, a plurality of conductive terminals 30 and a flex printed circuit board 40. The flex printed circuit board 40 may be a portion of the printed circuit board 100. Alternatively, the flex printed circuit board 40 may be connected to the printed circuit board 100.

The base 20 may be plastic, and includes a base body 21 and a plurality of arms 22. The base body 21 is substantially rectangular, and includes a first layer plate 211 and a second layer plate 212. Ends of the first layer plate 211 and the second layer plate 212 are coplanar. A distance between two sides of the first layer plate 211 is less than the distance between two sides of the second layer plate 212. The two sides of the first layer plates 211 define a plurality of parallel spaced slots 213. The second layer plate 212 defines a plurality of spaced grooves 214 corresponding to the slots 213. A length of each groove 214 is less than that of each slot 213. Each arm 22 respectively extends from one of the corners of the second layer plate 212, cooperatively forming a cavity for receiving the digital camera module 10. Each arm 22 includes two spaced columns 221 extending from the second layer plate 212. A distal end of the two columns 221 forms a hook 222 receivable in the stepped portion 131 of the digital cameral module 10. The two separate columns 221 may easily deform the arm 22.

Each conductive terminal 30 has a substantially n-shaped cross section, and includes two extended portions 31, 32. The extended portions 31, 32 connect at one end thereof. The extended portion 31 has an angled portion 311 at a free end thereof. The extended portion 32 has a bent portion 321 bending outwardly from a free end thereof. The conductive terminals 30 are a stainless material or other similar metal material. The conductive terminal 30 may be deformable under outside forces. When the conductive terminals 30 are mounted to the base 20, the extended portions 31 are received in the slots 213. The angled portions 311 project from the slots 213 of the first layer plate 211 to electronically connect with the digital cameral module 10. The extended portions 32 abut the second layer plate 212. The bent portions extend into the grooves 214 and latch the second layer plate 212 to electronically connect with a plurality of second contacts 41 of the flex printed circuit board 40.

Figure 3:
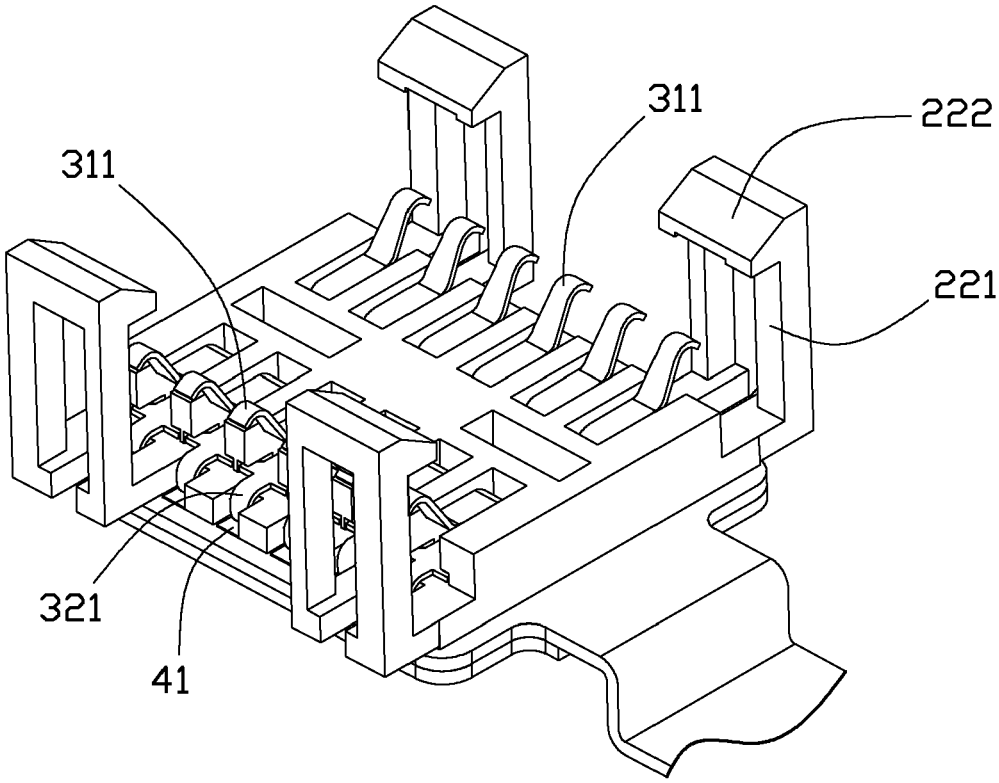
FIG. 3 is a partially assembled view of FIG. 1.
Figure 4:
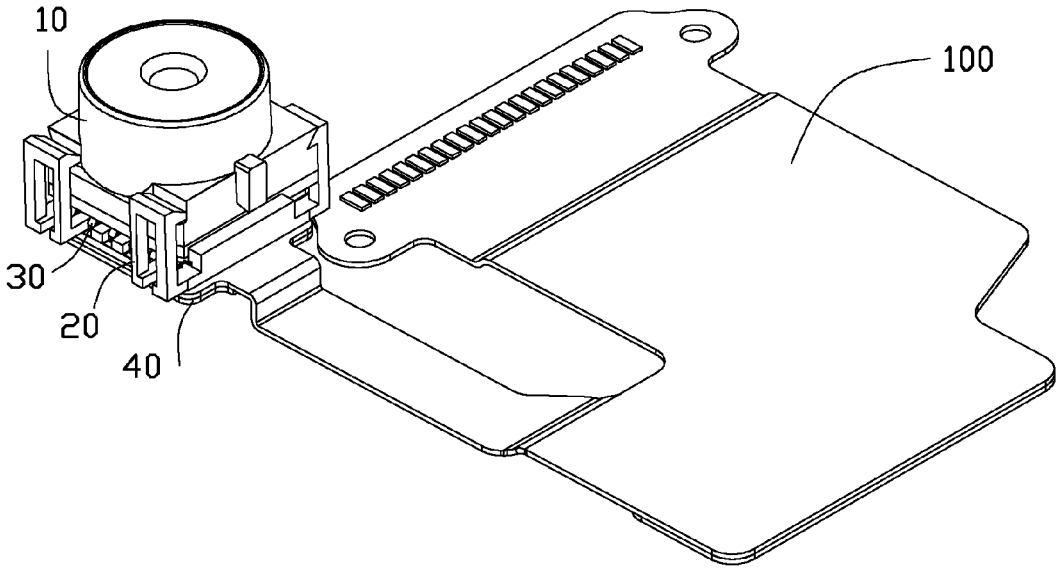
FIG. 4 is an assembled view of FIG. 1.

During assembly, referring to FIGS. 3 and 4, the conductive terminals 30 are respectively latched in the slots 213 and the grooves 214 of the base 20. The base 20 is connected to the flex printed circuit board 40 by, e.g., hot melting. The conductive terminals 30 are electrically connected with the second contacts 41 of the flex printed circuit board 40. When the digital camera module 10 is placed in the socket connector 200, the arms 22 are forced outward until the angled portions 311 resist the first contacts 15. After the digital camera module 10 is completely received in the cavity of the base 20, the arms 22 resume the original state. The hooks 222 latch in the stepped portions 131, fixing the digital camera module 300 in the socket connector 200. Assembly of the digital camera module 10 is thus completed. The socket connector 200 provides a stable electrical connection with the digital camera module 10, and the socket connector 200 may be further connected with the printed circuit board 100.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A socket connector, the socket connector comprising:

a base including a base body and a plurality of arms extending from the base for retaining a camera module, the base body including a first layer plate and a second layer plate;

a plurality of contact terminals mounted on the base, each contact terminal including an angled portion and a bent portion, the angled portion for electronically connecting to the digital cameral module; and a flex printed circuit board to which the bent portion is electronically connected.

2. The socket connector as claimed in claim 1, wherein two ends of the first layer plate and the second layer plate are coplanar and a distance between two sides of the first layer plate is less than the distance between two sides of the second layer plate.

3. The socket connector as claimed in claim 2, wherein the first layer plate defines a plurality of parallel spaced slots, and the second layer plate defines a plurality of spaced grooves corresponding to the slots.

4. The socket connector as claimed in claim 3, wherein each conductive terminal has a substantially n-shaped cross section, and includes two extended portions connecting to each other at one end thereof, and one of extended portions is received in a corresponding slot.

5. The socket connector as claimed in claim 2, wherein each arm includes two spaced columns extending from the second layer plate, wherein a distal end of the two columns forms a hook.

6. A socket connector for receiving a digital camera module, the digital cameral module including at least one step portion, the socket connector comprising:

a base including a base body and a plurality of arms extending from the base, each arm forming a hook latching in the at least one stepped portion, the base body including a first layer plate and a second layer plate;

a plurality of contact terminals mounted in the base, each contact terminal including an angled portion and a bent portion, the angled portion electronically connected to the digital cameral module; and a printed circuit board electronically connected to the bent portion.

7. The socket connector as claimed in claim 6, wherein each arm includes two spaced columns extending from the second layer plate.

8. The socket connector as claimed in claim 7, wherein each conductive terminal has a substantially n-shaped cross section, and includes two extended portions connecting to each other at one end thereof.

9. The socket connector as claimed in claim 8, wherein the first layer plate defines a plurality of parallel spaced slots, and the second layer plate defines a plurality of spaced grooves corresponding to the slots.

* * * * *